US005231972A

United States Patent [19]

Galassi

[11] Patent Number: 5,231,972

[45] Date of Patent: Aug. 3, 1993

[54] EXTRACTABLE, VARIABLE INTAKE/PURIFICATION DEVICE IN A COOK TOP

[75] Inventor: Alvaro Galassi, Fossato Di Vico, Italy

[73] Assignee: Faber S.p.A., Fabriano, Italy

[21] Appl. No.: 942,859

[22] Filed: Sep. 10, 1992

[30] Foreign Application Priority Data

Sep. 12, 1991 [IT] Italy ..... MI91-U-000784

[51] Int. Cl.[5] ..... F24C 15/20

[52] U.S. Cl. ..... 126/299 R; 126/300; 126/303

[58] Field of Search ..... 126/299 R, 299 D, 299 E, 126/300, 303, 21 R; 55/DIG. 36; 454/67, 62, 49

[56] References Cited

U.S. PATENT DOCUMENTS

| | | | |
|---|---|---|---|
| 2,674,991 | 4/1954 | Schaefer | 126/299 R |
| 4,446,849 | 5/1984 | McFarland | 126/299 R |

FOREIGN PATENT DOCUMENTS

| | | | |
|---|---|---|---|
| 54285 | 6/1982 | European Pat. Off. | 126/299 R |
| 2810318 | 9/1979 | Fed. Rep. of Germany | 126/299 R |
| 82887 | 4/1955 | Netherlands | 126/299 R |

*Primary Examiner*—James C. Yeung

*Attorney, Agent, or Firm*—Jacobson, Price, Holman & Stern

[57] ABSTRACT

A fume extraction device for a cook top on a frame which has at least two cooking elements is disclosed. The device is in the form of a drawer which can be raised and lowered in the frame between the cooking elements. There are two openings in the drawer facing the respective cooking elements and filters in the openings. An adjustable baffle is provided for controlling the flow through the openings and there is a further inclined filter in the drawer below the baffle. The drawer can be raised to selected positions depending on the height of fumes being generated during cooking.

2 Claims, 3 Drawing Sheets

EXTRACTABLE, VARIABLE INTAKE/PURIFICATION DEVICE IN A COOK TOP

BACKGROUND OF THE INVENTION

The present invention relates to an extractable, variable intake/purification device in a cook top of a stove or the like.

Heretofore, devices were positioned over the cook tops, collect cook fumes, by sucking them upwards. In general, such devices had the structure of wall-mounted hoods.

Problems of room unavailability in such an upper position, or, more simply, aesthetical problems have progressively led those skilled in the art to look for alternative solutions, consisting in devices directly installed in the vicinity of, or inside, the cook top.

A first solution known from the prior art consisted in installing behind the cook top an intake mouth, which might be of either fixed, or extractable type. In that way, an undoubted advantage was accomplished as to space occupied, but the intake of fumes from containers positioned near the opposite edge of the cook top proved to be difficult.

A second solution consisted in providing on the cook top, for example in a middle position, a fixed mouth for fume intake. In that case, the suction is severely limited by the excessive and unnatural stress the intake unit must exert on the fumes in order to force them to flow downwards, and reach the intake mouth.

SUMMARY OF THE INVENTION

A purpose of the present invention is of providing an intake/purification device in a cook top, which intake/-purification device is improved as far as possible regarding fume intake independently from the source from which the fumes take their origin.

Another purpose is of providing a device for a cook top, which device makes possible a suction action, which can be varied as a function of the zone from which the fumes and vapours are released.

These purposes according to the present invention are achieved by providing an extractable, variable intake/purification device in a cook top comprising at least one intake mouth provided in a base/support framework equipped with support surfaces and a plurality of burners, said intake mouth being connected with a suction means installed inside said framework, characterized in that said intake mouth is arranged transversely to said base/support framework in such a way as to subdivide it into two portions, and is constituted by a vertically-extractable drawer element provided with openings on mutually opposite sides facing said two portions, with a baffle element being furthermore provided inside said drawer element in order to enable said two openings to be selectively shut.

BRIEF DESCRIPTION OF THE DRAWINGS

The characteristics and advantages of a device according to the present invention shall be set forth more clearly from the following disclosure of an exemplifying, non-limitative form of practical embodiment referred to the accompanying schematic drawings, in which.

DESCRIPTION OF PREFERRED EMBODIMENT

Figure 1:
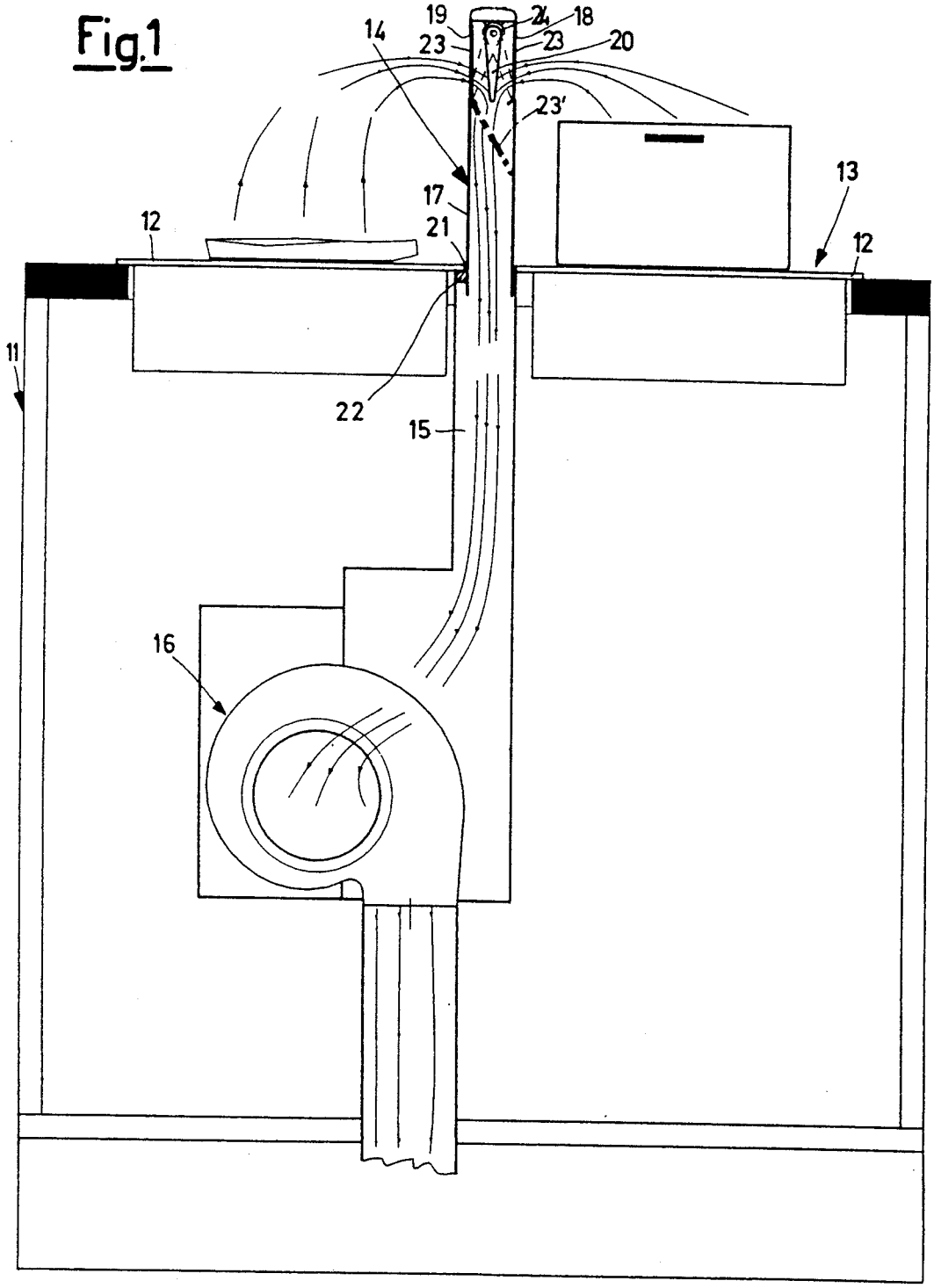
FIG. 1 is a schematic elevational, partially sectional view of a cook top equipped with a device according to the present invention.
Figure 2:
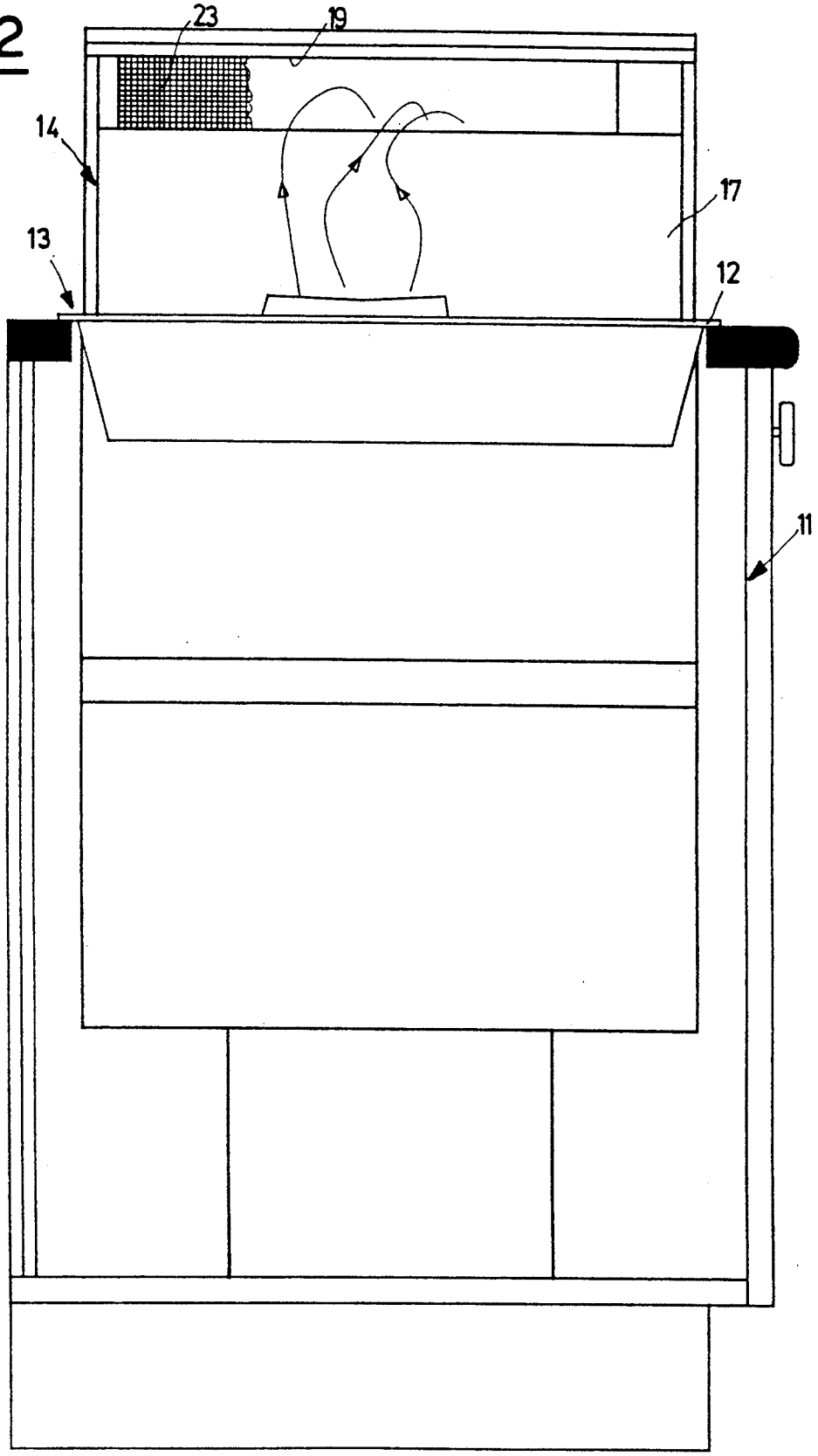
FIG. 2 is a cross-sectional view of the cook top of FIG. 1.
Figure 3:
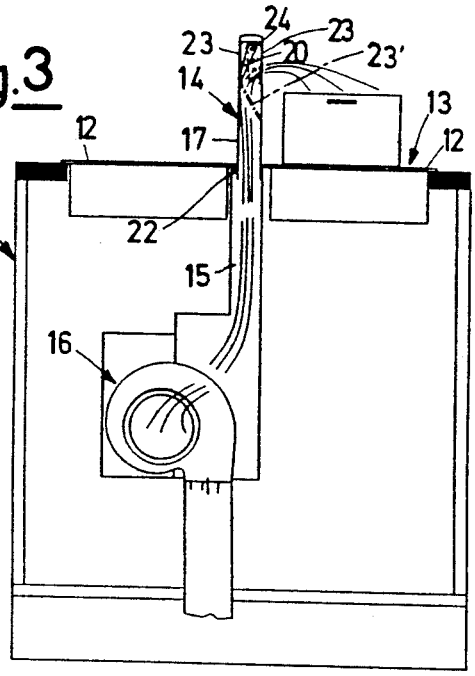
FIGS. 3 and 4 are views similar to FIG. 1, on reduced scale, of details of the device in different operating intake positions.
Figure 4:
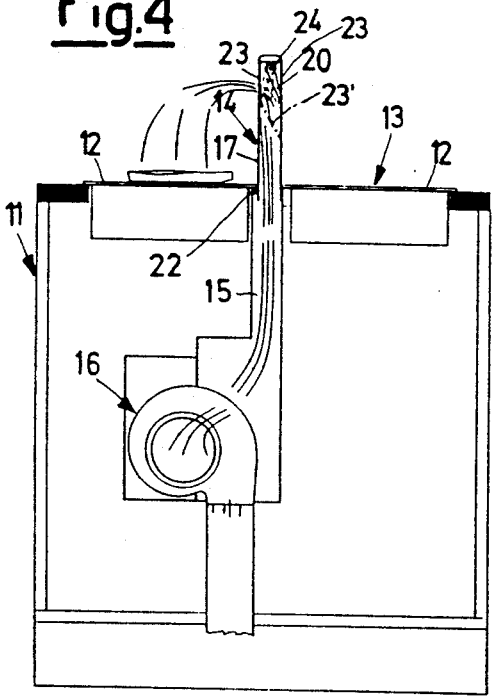
Figure 5:
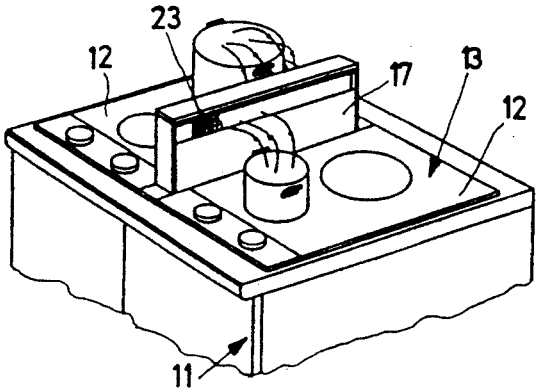
FIG. 5 is a perspective view, on a reduced scale.

An extractable, variable intake/purification device in a cook top according to the present invention is provided in a base support framework 11 having support surface 12 and a plurality of burners 13, which may be gas-fired, electrical, or of various kinds.

Inside the support surfaces 12, at a middle portion of the framework 11 an intake element or mouth 14 is provided, which is oriented in a transverse relative to the burners, and is connected, through a channel 15, with an underlying suction means 16 also contained inside the framework 11.

The intake mouth 14, is such as to subdivide into two portions both the support surfaces 12, and the framework 11. In particular, the intake mouth is constituted by a drawer element 17 of prismatic form with a rectangular cross-section extending in transverse said transversal direction. Such a drawer element 17 is vertically extractable and is provided in its top portion with at least two openings 18 and 19 along the opposite longer sides of its rectangular cross-section, orientated towards said two opposite portions of the cook top. Inside said drawer element 17, there is furthermore provided a baffle element 20 for selectively shutting said two openings 18 and 19.

The drawer element 17 can be adjusted or its position in height, and its walls can slide relatively to a sliding seat 21 provided on the upper surface of the framework 11. At said sliding seat or opening 21, tight-sealing elements 22 are provided.

Inside the drawer element 17, at said two openings 18 and 19, removable filter elements 23 are provided which enable the operation of the device to be optimized. According to an alternative solution, under said two openings 18 and 19, inside said hollow body of the drawer a removable filter element 23' — shown in phantom line — can additionally be provided, for example in a slanting position, which, in that way, improves and optimizes the filtering surface.

One should observe that in the device according to the present invention the baffle element 20 can also be positioned inside the drawer element 17 in a central, essentially vertical position, in such a way as to leave both openings 18 and 19 open, so as to enable the intake action to take place simultaneously on both sides, from both portions of the cook top, i.e., from all burners.

The baffle element 20 is hinged to the drawer element 17 and bears an associated spring element 24, which causes the baffle element 20 to be stably positioned in one of its three possible positions.

Advantageously, due to the presence of the sliding seat 21 with tightly sealing means, said drawer element 17 can be lifted to any preselected position, in order to make the best use of its intake power.

I claim:

1. A fume extraction device for a cook top mounted atop a frame and having at least two spaced cooking elements on the cook top, the device comprising a vertically displaceable drawer element mounted in the frame between the cooking elements for lowering into the frame and raising above the cook top to selected vertical positions, the drawer element being in gas flow communication with suction means within the frame, the drawer element including opposed openings facing the respective cooking elements, fume filters in the respective openings, an adjustable baffle between the filters for controlling flow of cooking fumes through the respective openings, the baffle having first and second positions closing the respective openings and a third central position allowing flow of fumes through both openings, and a further filter in the drawer element below the baffle.

2. A device as claimed in claim 1, wherein the further filter is inclined.

* * * * *